US006209798B1

(12) United States Patent
Martin et al.

(10) Patent No.: US 6,209,798 B1
(45) Date of Patent: Apr. 3, 2001

(54) TAPPET RETENTION FOR A FUEL INJECTOR

(75) Inventors: David E. Martin, Normal; Jeffrey R. Ries, Metamora; James J. Streicher, Pontiac, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/475,934

(22) Filed: Dec. 30, 1999

Related U.S. Application Data

(63) Continuation-in-part of application No. 08/955,588, filed on Oct. 22, 1997, now abandoned.

(51) Int. Cl.[7] ..... F02M 47/00
(52) U.S. Cl. ..... 239/88; 239/92
(58) Field of Search ..... 239/88–92

(56) References Cited

U.S. PATENT DOCUMENTS

| | | | |
|---|---|---|---|
| 3,982,693 | | 9/1976 | Hulsing . |
| 4,402,456 | | 9/1983 | Schneider . |
| 4,485,969 | | 12/1984 | Deckard et al. . |
| 4,505,243 | | 3/1985 | Miwa . |
| 4,653,455 | | 3/1987 | Eblen et al. . |
| 5,082,180 | | 1/1992 | Kubo et al. . |
| 5,360,164 | | 11/1994 | Pape et al. . |
| 5,370,095 | | 12/1994 | Yamaguchi et al. . |
| 5,402,764 | | 4/1995 | Rossignol et al. . |
| 6,029,902 | * | 3/2000 | Hickey et al. ..... 239/88 |
| 6,032,875 | * | 3/2000 | Grimshaw-Jones ..... 239/92 X |

FOREIGN PATENT DOCUMENTS

| | | |
|---|---|---|
| 2 113 775 | 1/1983 | (GB) . |
| 2 240 141 | 12/1990 | (GB) . |
| 92/10668 | 11/1991 | (WO) . |
| 93/07385 | 4/1993 | (WO) . |

OTHER PUBLICATIONS

Author: Unknown. Drawing of of Spring loaded means for Caterpillar 3406E Fuel Injector. Date: Publically Available Since About 1994.

* cited by examiner

*Primary Examiner*—Lesley D. Morris
(74) *Attorney, Agent, or Firm*—Michael B. McNeil

(57) ABSTRACT

A fuel injector includes a tappet assembly mounted on an injector body. At least one of the tappet assembly and the injector body define a retention opening therethrough. A retention member is positioned in the retention opening and concealed by at least one of the tappet assembly and the injector body. The tappet assembly is moveable with respect to the injector body an unadjustable displacement distance between an advanced position and an extended position. The height of the retention opening is less than the unadjustable displacement distance.

20 Claims, 7 Drawing Sheets

TAPPET RETENTION FOR A FUEL INJECTOR

RELATION TO OTHER PATENT APPLICATION

This application is a continuation-in-part of application Ser. No. 08/955,588, filed Oct. 22, 1997, and entitled TAPPET RETENTION FOR A FUEL INJECTOR and now abandoned.

TECHNICAL FIELD

The present invention relates generally to tappet assemblies for fuel injectors, and more particularly to a mechanism that maintains a tappet connected to the body of a fuel injector during shipping, handling and installation.

BACKGROUND ART

One class of fuel injectors are mechanically actuated via a rocker arm assembly that moves with each rotation of an engine's cam shaft. The rocker arm moves a tappet downward, and a plunger underneath the tappet pressurizes fuel during the downward stroke. A spring retracts the plunger and tappet between injection events. The spring, which is always compressed, also maintains the tappet in contact with the rocker arm throughout the operation of the system. In most of these types of injectors, the compression spring pushes the tappet away from the injector body, but the rocker arm limits how far the tappet can be moved away from the injector body, and thus prevents the tappet from disconnecting from the injector body after installation.

During assembly, shipping and handling before the injector is installed in an engine, there is often the possibility that the tappet will accidentally disconnect from the injector body. This occurs because the tappet return spring pushes the tappet away from the injector body, and there is often no means provided for holding the tappet connected to the injector body prior to installation. In some instances, it is possible to use an external clamping mechanism to hold the tappet to the injector body prior to, and during, installation in an engine. However, in many cases space constraints during installation are so severe that no room on the outside of the assembled injector is available for retaining the tappet in the injector body. In these cases, one must either include an internal retention means or accept the risk that some tappets will become disconnected from their respective injector bodies during pre-installation shipping and handling. Oftentimes internal retention means are limited or unavailable due to internal structural and space constraints. In addition, any retention means should be either removable upon installation or arranged such that the same will not interfere with normal operation of the injector after being installed in an engine.

The present invention is directed to overcoming one or more of the problems as set forth above.

DISCLOSURE OF THE INVENTION

A fuel injector includes a tappet assembly mounted on an injector body. At least one of the tappet assembly and the injector body define a retention opening therethrough. A retention member is positioned in the retention opening and concealed by at least one of the tappet assembly and the injector body. The tappet assembly is moveable with respect to the injector body an unadjustable displacement distance between an advanced position and an extended position. The height of the retention opening is less than the unadjustable displacement distance.

BEST MODE FOR CARRYING OUT THE INVENTION

Figure 1:
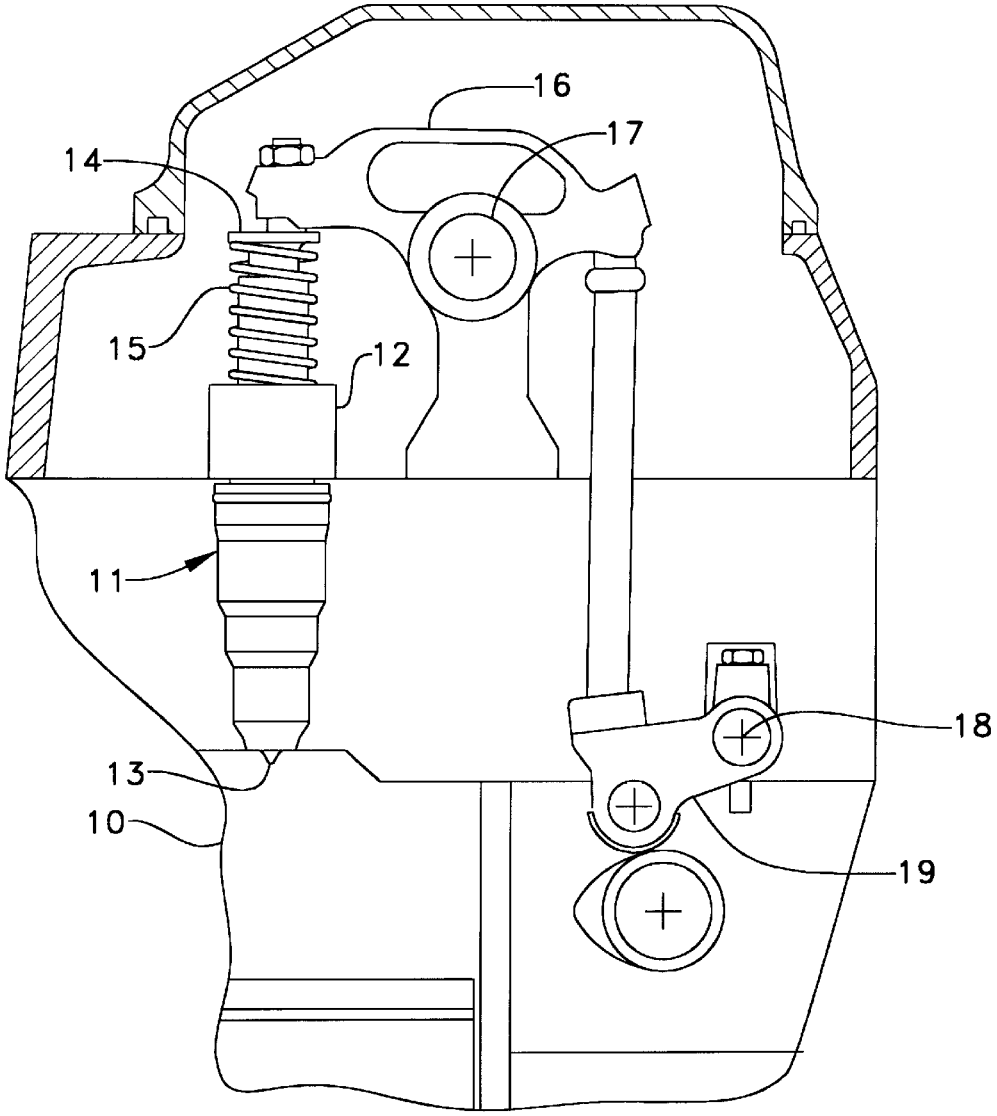
FIG. 1 is a sectioned side diagramatic view of an engine with a fuel injector according to the present invention installed therein.

Referring now to FIG. 1, an engine 10 has a fuel injector 11 installed such that nozzle outlet 13 opens to a cylinder bore, as in a conventional diesel type engine. With each cycle of the engine, a lifter assembly 19 is moved upward about lifter group shaft 18. Lifter assembly 19 acts upon rocker arm assembly 16, which is mounted to pivot about rocker arm shaft 17. A portion of rocker arm assembly 16 is in contact with a tappet 14 that is mated to injector body 12 of fuel injector 11. A compression spring 15 has one end in contact with injector body 12 and its other end in contact with tappet 14. Compression spring 14 normally pushes tappet 14 away from injector body 12, such that rocker arm assembly 16 maintains contact with tappet 14 in a conventional manner. With each cycle of engine 10, tappet 14 is driven downward to move a plunger within injector body 12. The downward stroke of the plunger within fuel injector 11 pressurizes fuel so that fuel commences to spray out of nozzle outlet 13 in a manner well known in the art.

Figure 2:
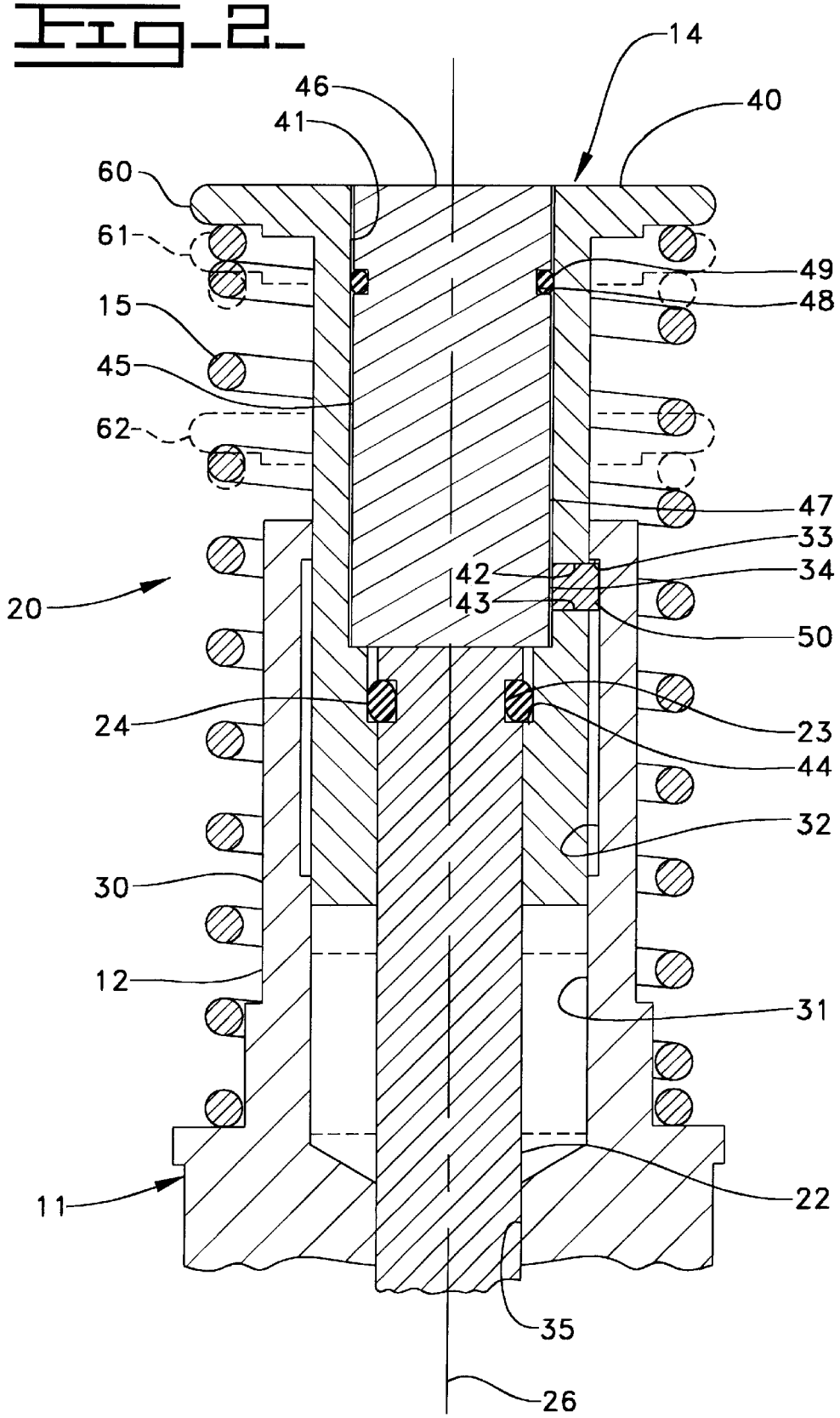
FIG. 2 is a sectioned side diagramatic view of an upper portion of a fuel injector according to one embodiment of the present invention.

Referring now to FIG. 2, the upper portion 20 of fuel injector 11 is shown as it would appear during pre-installation shipping and handling. In this embodiment, injector body 12 defines a tappet bore 31 through a tappet barrel 30, which defines an annular indentation 32. Indentation 32 and bore 31 are centered about centerline axis 26. A portion of annular indentation 32 is defined by an annular ledge 33 that preferably lies in a plane perpendicular to axis 26. Annular ledge 33 can be thought of as an upper retention surface. Although annular ledge 33 is shown horizontal, it can also have a rounded, frusto conical, or other shape depending on machining and other considerations. A plunger 22 includes an annulus 23 near its upper end that receives a retainer ring 24 to connect plunger 22 to holder member 40.

Tappet assembly 14 includes plunger 22, plug member 45 and holder member 40, which has a male extension portion that is guided in tappet bore 31, which can be considered a female portion. Together, holder member 40 and plug member 45 can be thought of as the tappet for tappet assembly 14. Holder member 40 also includes a plug bore 41 and a retention opening 42 within which is positioned a retention member 50. In this embodiment, retention opening 42 is preferably circular, and retention member 50 is preferably a cylindrical pin. Opening 42 preferably has a diameter just larger than that of cylindrical pin 50. The bottom portion of side opening 42 acts as a lower retention surface 43. A plug member 45 rests on a ledge in plug bore 41 and has one end adjacent plunger 22 and an other end that includes a rocker arm contact surface 46. Plug member 41 includes an annulus 48 that receives an o-ring 49 that creates a friction fit to prevent the plug member 41 from falling out of holder member 40 during pre-installation shipping and handling.

A compression spring 15 normally pushes tappet assembly 14 away from injector body 12 to an extended position 60, as shown, in which cylindrical pin 50 is pinched between upper retention surface 33 and lower retention surface 43. This occurs because cylindrical pin 50 has a length that is greater than the wall thickness of holder member 40. Annular surface 34 of plug member 45 maintains cylindrical pin 50 a minimum distance away from centerline axis 26. This insures that a portion of cylindrical pin 50 always protrudes into annular indentation 32 so that pin 50 comes in contact with upper retention surface 33 when compression spring 15 pushes tappet assembly 14 upward. After installation, tappet assembly 14 moves between an installed retracted position 61 and an advanced position 62 during normal operation of fuel injector 11. Thus, after installation, cylindrical pin 50 no longer has the possibility of coming in contact with upper retention surface 33. This prevents cylindrical pin 50 from having any significant effect on the operation of fuel injector 11 after the same is properly installed in an engine.

During assembly, retainer ring 24 is attached to plunger 22 and the same is inserted into holder member 40 away from injector body 12. This subassembly is then mated to injector body 12 by inserting the male portion of tappet assembly 14 into the female portion of injector body 12 such that plunger 22 is located in its guide bore 35. After this occurs, cylindrical pin 50 is positioned in opening 42 and plug member 45 is advanced into plug bore 41. This traps pin 50 in side opening 42 between annular surface 34 of plug member 41 and injector body 12.

Figure 3:
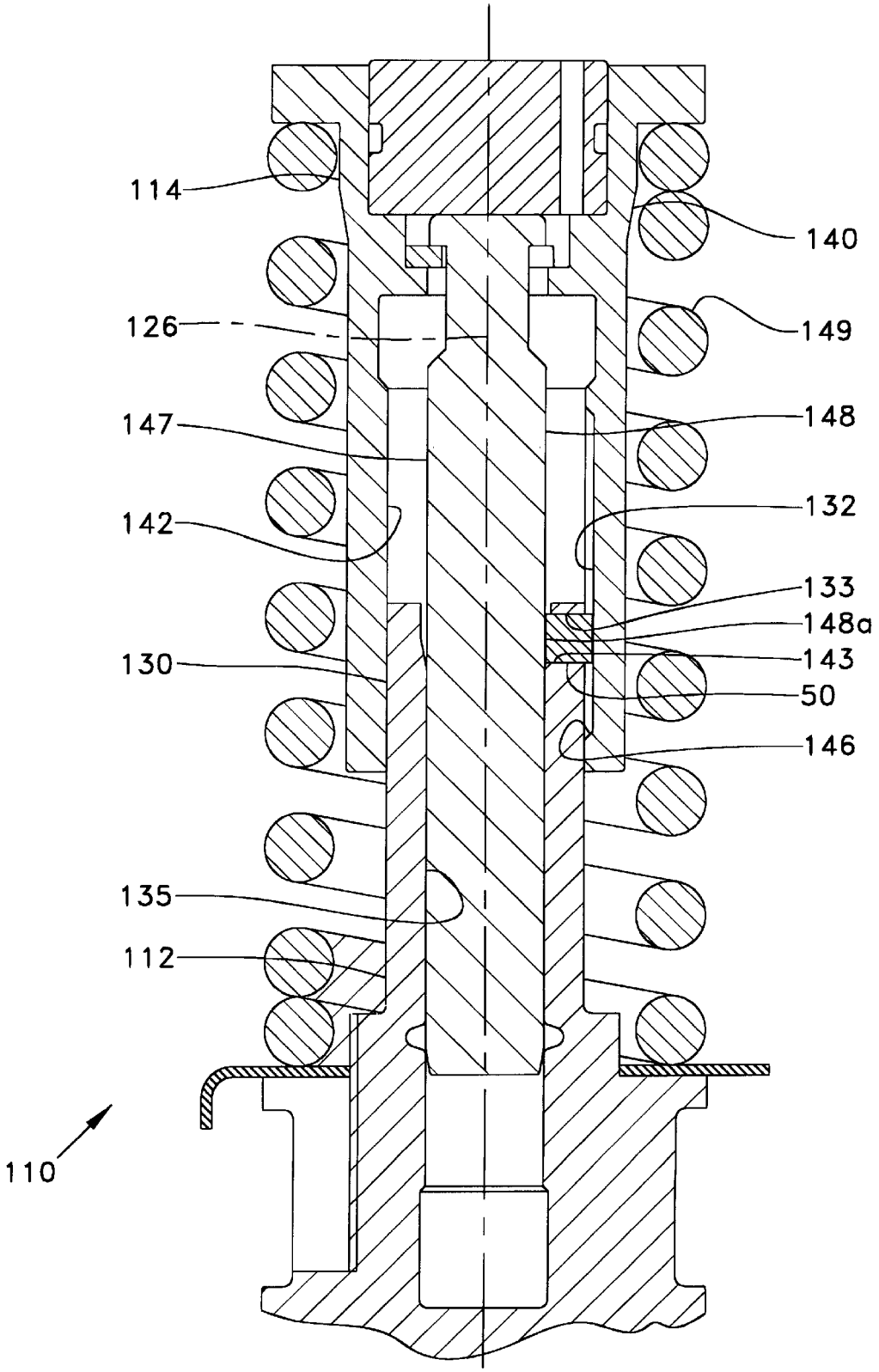
FIG. 3 is a sectioned side diagramatic view of an upper portion of a fuel injector according to another embodiment of the present invention.

Referring now to FIG. 3, an alternative embodiment of the present invention is illustrated in which a tappet assembly 114 guided on the outer surface of injector body 112, instead of vice versa as in the previous embodiment. In other words, in this embodiment injector body 112 includes a male portion that is mated to a female portion of tappet assembly 114, whereas the opposite was true for the previous embodiment. This embodiment also differs in that the side opening 143 is made through injector body 112, and the cylindrical pin 50 is trapped between annular surface 148 of plunger 147 and holder member 140. Plunger 147 is guided in plunger bore 135, which is an inner surface of injector body 112. In this embodiment, the outer surface 148*a* of plunger 147 maintains cylindrical pin 50 a minimum distance away from injector centerline axis 126. Tappet assembly 114 is locked onto injector body 112 since pin 50 has a length greater than the wall thickness of tappet barrel 130, which is received in guide bore 142. This ensures that a portion of pin 50 always protrudes into an indentation 132 made in holder member 140.

FIG. 3 shows fuel injector 110 in its installed retracted position, in which cylindrical pin 50 is away from lower retention surface 146. Before installation in an engine, compression spring 149 naturally pushes tappet assembly 114 to an extended position in which cylindrical pin 50 is pinched between lower retention surface 146 and upper retention surface 133. Upper retention surface 133 is the upper portion of opening 143 through the tappet barrel portion 130 of injector body 112. A subtle advantage of this embodiment relates to the vertical conservation of design space by simultaneously guiding holder portion 140 and plunger 147 on respective inner and outer surfaces of injector body 112 over an identical segment of centerline 126.

Figure 4:
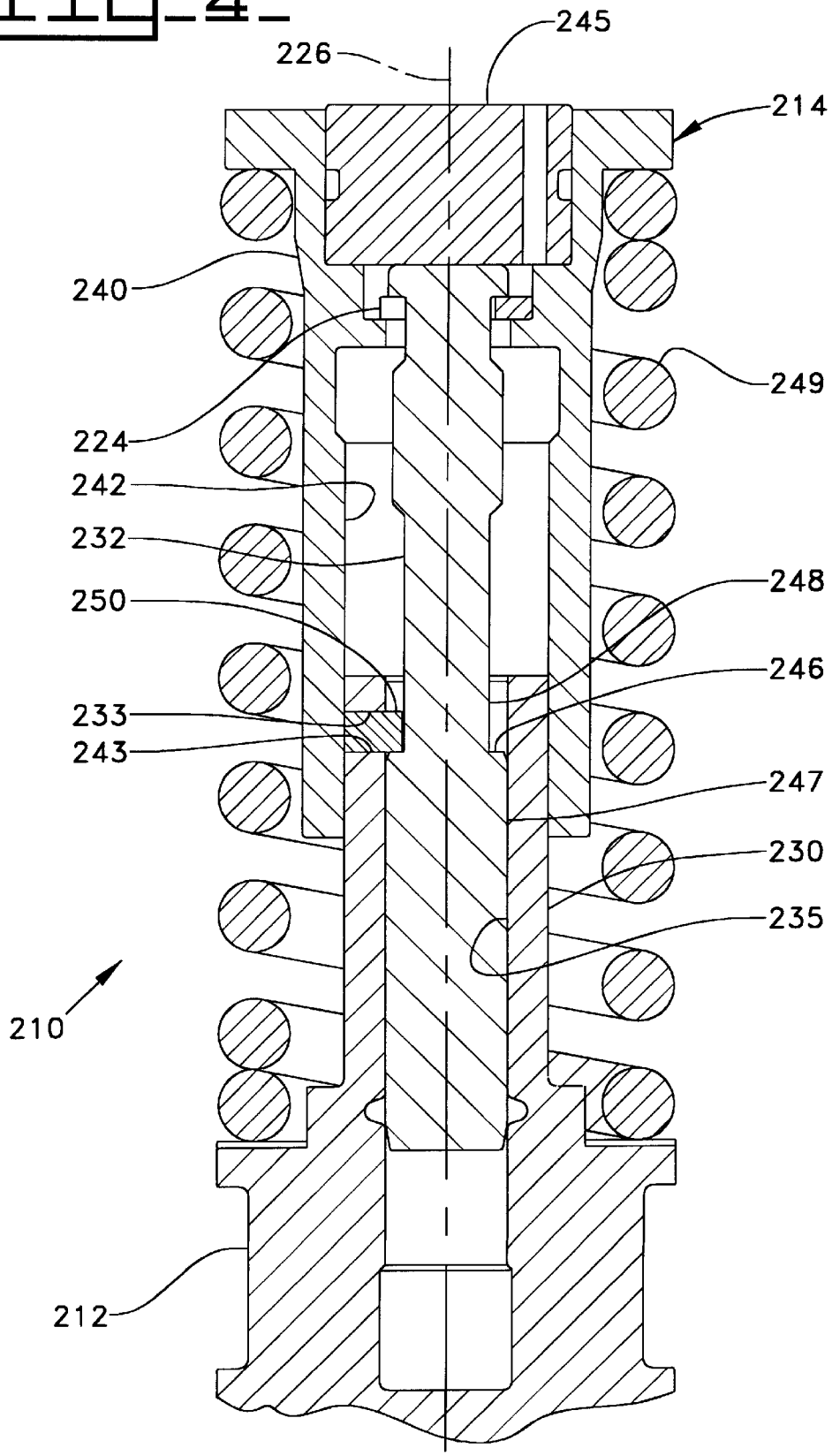
FIG. 4 is a sectioned side side diagramatic view of an upper portion of a fuel injector according to still another embodiment of the present invention.

Referring now to FIG. 4, still another embodiment of a fuel injector 210 according to the present invention is illustrated. This embodiment shares the vertical design space conservation feature of the previous embodiment by at lease partly guiding its tappet and plunger at an overlapping segment of centerline 226. This embodiment differs from the embodiment of FIG. 3 in that the indentation has been moved from the inner surface of the holder member to the outer surface of the plunger. However, the retention member is still a cylindrical pin, and the retention surfaces are oriented perpendicular to centerline 226 as in the previous embodiments. This embodiment is also necessarily assembled in a different order from the preceding embodiments.

First, plunger 247 is advanced into plunger bore 235. Next, the retention member 250 is positioned in side opening 243, which is preferably circular and made through the wall of tappet barrel 230. Retention member 250 preferably has a uniform diameter just smaller than the diameter (height) of side opening 243. Next, the biasing compression spring 249 is positioned on top of injector body 212. Holder member 240 is then advanced so that tappet barrel 230 is received in a guide bore 242 in holder member 240. Holder member 240 is advanced far enough that a retaining clip 224 can be attached to plunger 247. Finally, a plug member 245 is attached to holder member 240 in the position shown.

By assembling the tappet assembly for the fuel injector 210 in this order, the assembly will not come apart, even under the action of compression spring 249. Retention member 250 is longer than the thickness of the wall of tappet barrel 230 such that a portion of it always protrudes into an annular indentation 232 that is machined around the side of plunger 247. A portion of annular indentation 232 is defined by a lower retention surface 246 that contacts retention member 250 when tappet assembly 214 is at its extended position, as shown. When in this position, retention member 250 is pinched between upper retention surface 233, which is a portion of side opening 243, and lower retention surface 246. At the same time, retention member 250 is trapped between the inner surface of holder member 240 and annular surface 248, to maintain the same a minimum distance from centerline 226.

Figure 5:
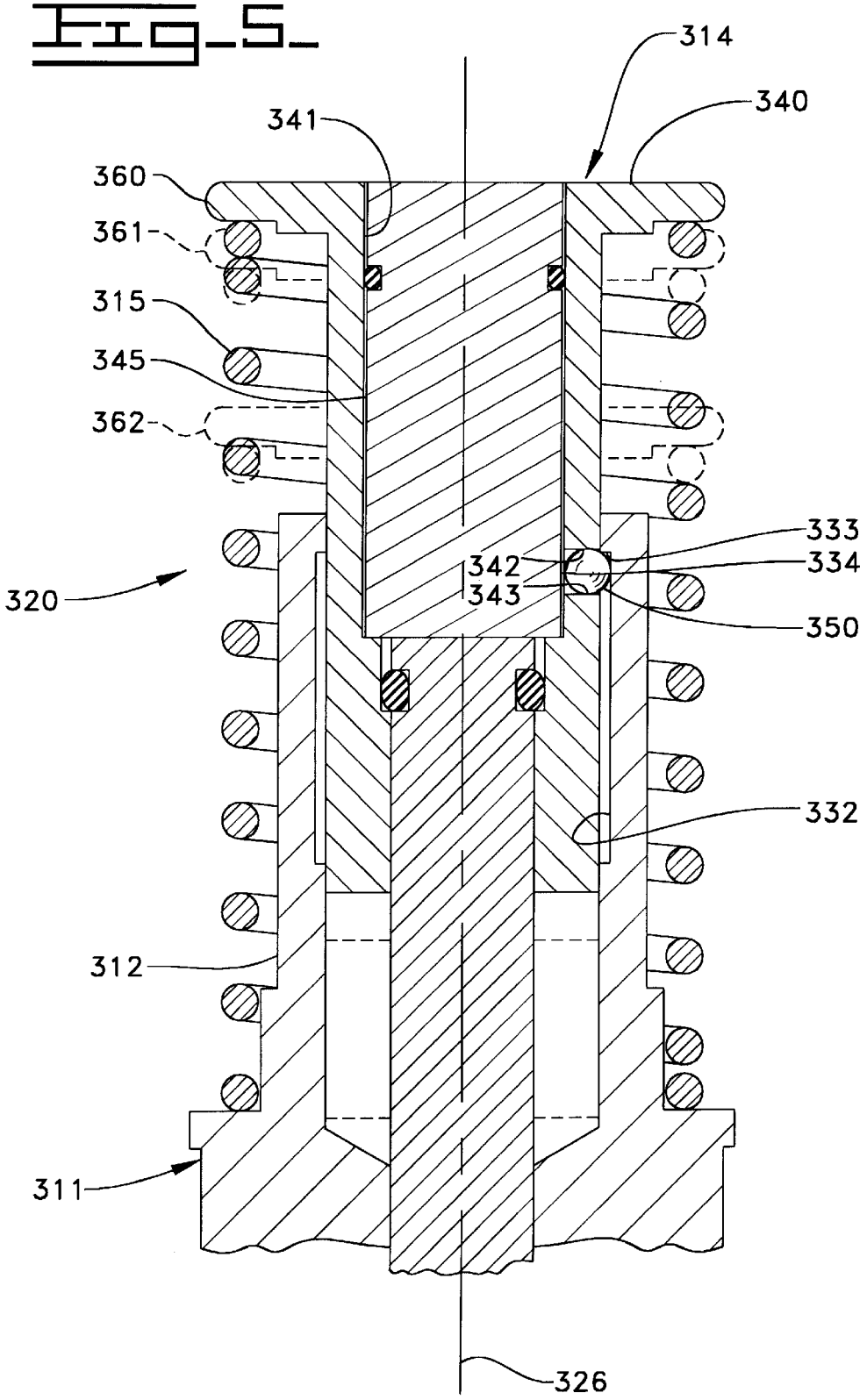
FIG. 5 is a sectioned side diagramatic view of an upper portion of a fuel injector according to still another embodiment of the present invention.

Referring now to FIG. 5, yet another embodiment of the present invention is illustrated. Note that the FIG. 5 embodiment is substantially similar to the embodiment illustrated in FIG. 2, with the exception that cylindrical pin 50 has been replaced by a retention ball 350. While the embodiment illustrated in FIG. 2 including a cylindrical pin is preferable, retention ball 350 could instead be utilized as shown in FIG. 5 with adequate results.

The use of a ball is less desirable than a cylindrical pin at least in part because of the tendancy of the ball to exert side forces on the tappet assembly when in the extended position, as shown. In addition, the invention can usually be accomplished with a pin having a substantially diameter than a ball, because of the need for an adequate amount of the retention member to protrude into the indentation. Thus, by utilizing a cylindrical pin over that of a ball, one can gain additional precious vertical design space for other portions of the fuel injector.

As with the FIG. 2 embodiment, a holder member 340 includes a plug bore 341 and a retention opening 342 within which retention ball 350 is placed. Opening 342 has a diameter that is just larger than that of retention ball 350. The bottom of side opening 342 acts as a lower retention surface 343. As with the FIG. 2 embodiment, a compression spring 315 normally pushes tappet assembly 314 away from injector body 312 to an extended position 360, as shown, in which retention ball 350 is pinched between an upper retention surface 333 and lower retention surface 343. This occurs because retention ball 350 has a diameter that is greater than the wall thickness of holder member 340. Annular surface 334 of plug member 345 maintains retention ball 350 a minimum distance away from centerline axis 326 to insure that a portion of retention ball 350 always protrudes into annular indentation 332 so that ball 350 comes in contact with upper retention surface 333 when compression spring 315 pushes tappet assembly 314 upward. After installation, tappet assembly 314 moves between an installed retracted position 361 and an advanced position 362 during normal operation of fuel injector 311. Thus, after installation, retention ball 350 no longer has the possibility of coming in contact with upper retention surface 333. As with cylindrical pin 50 in the FIG. 2 embodiment, this prevents retention ball 350 from having any significant effect on the operation of fuel injector 11 after the same is properly installed in an engine.

Figure 6:
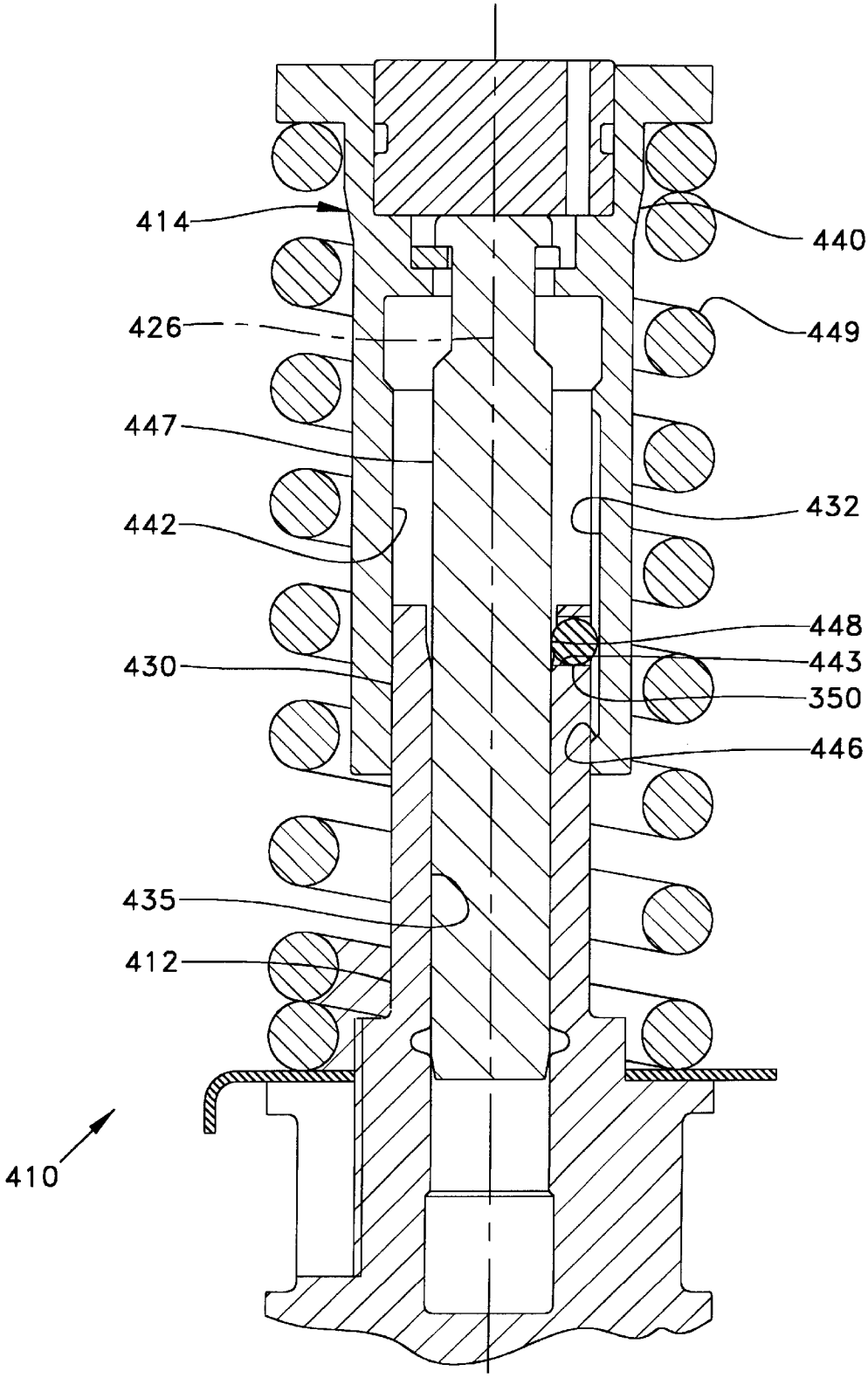
FIG. 6 is a sectioned side diagramatic view of an upper portion of a fuel injector according to yet another embodiment of the present invention.

Referring now to FIG. 6, still another alternative embodiment of the present invention is illustrated that is substantially similar to the FIG. 3 embodiment, except retention ball 350 has been substituted for cylindrical pin 50. In this embodiment, a tappet assembly 414 moves along the outer surface of injector body 412, as in FIG. 3. In other words, injector body 412 includes a male portion that is mated to a female portion of tappet assembly 414. Additionally, the side opening 443 is made through injector body 412, and the retention ball 350 is trapped between annular surface 448 of plunger 447 and holder member 440. Plunger 447 moves in plunger bore 435. In this embodiment, as with the FIG. 3 embodiment, the outer surface of plunger 447 maintains retention ball 350 a minimum distance away from injector centerline axis 426. Tappet assembly 414 is locked onto injector body 412 since ball 350 has a diameter greater than the wall thickness of tappet barrel 430, which is received in guide bore 442. This ensures that a portion of ball 350 always protrudes into an indentation 432 made in holder member 440.

FIG. 6 shows fuel injector 410 in its installed retracted position, in which retention ball 350 is away from lower retention surface 446. Before installation in an engine, compression spring 449 naturally pushes tappet assembly 414 to an extended position in which retention ball 350 is pinched between lower retention surface 446 and upper retention surface 433. Upper retention surface 433 is the upper portion of opening 443 through the tappet barrel portion 430 of injector body 412.

Figure 7:
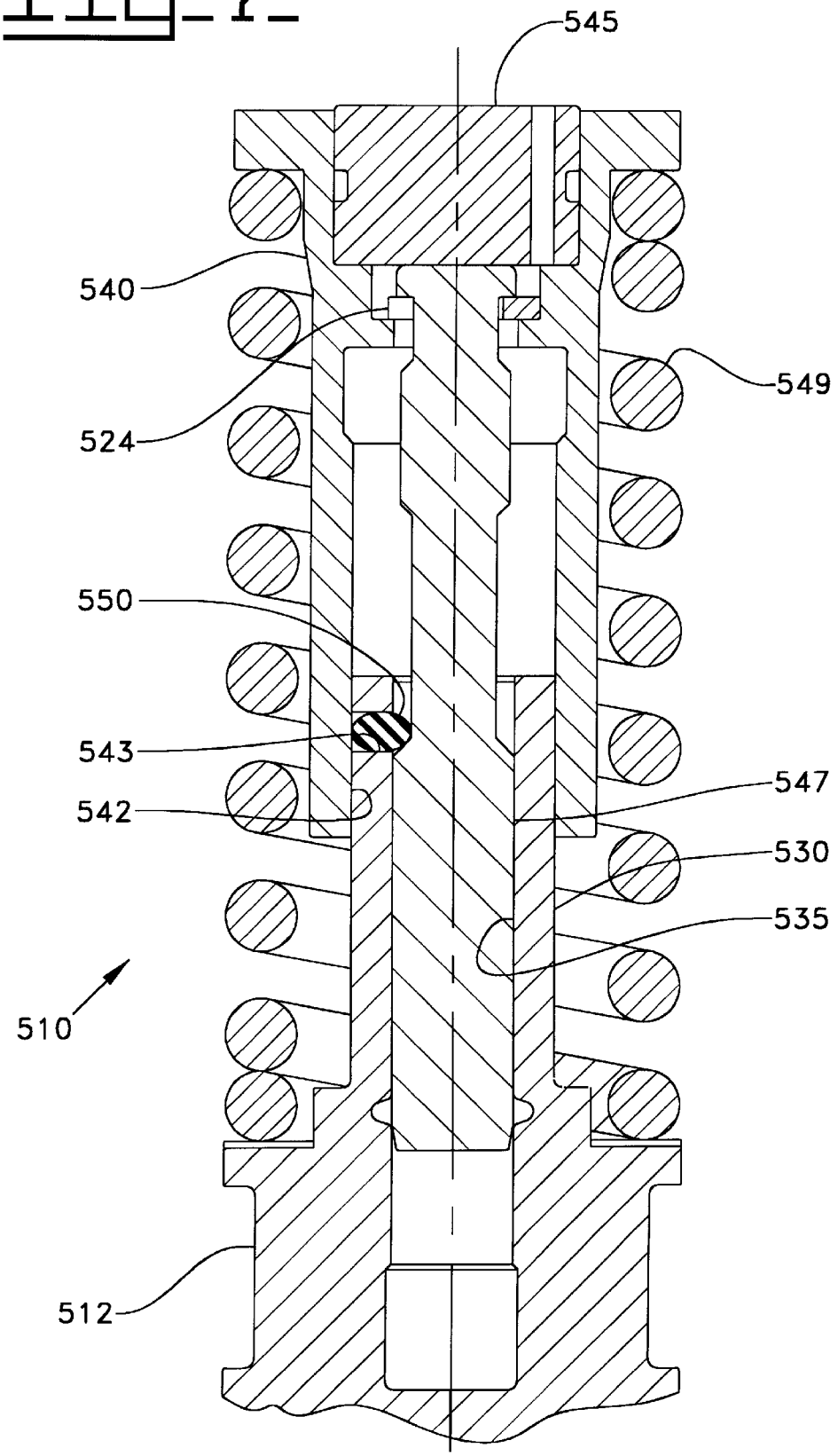
FIG. 7 is a sectioned side diagramatic view of an upper portion of a fuel injector according to still another embodiment of the present invention.

Referring now to FIG. 7, yet another embodiment of a fuel injector 510 according to the present invention is illustrated. Note that the FIG. 7 embodiment is substantially similar to the embodiment illustrated in FIG. 4. However, this embodiment differs from the embodiment of FIG. 4 in that the retention member has an oblong non-spherical shape, rather than a cylindrical pin. Assembly of this embodiment, however, is similar to that of the FIG. 4 embodiment. First, plunger 547 is advanced into plunger bore 535. Next, the oblong shaped retention member 550 is positioned in side opening 543, which is made through the wall of tappet barrel 530. Retention member 550 preferably has a small diameter just smaller than the diameter of side opening 543. Next, the biasing compression spring 549 is positioned on top of injector body 512. Holder member 540 is then advanced so that tappet barrel 530 is received in a guide bore 542 in holder member 540. Holder member 540 is advanced far enough that a retaining clip 524 can be attached to plunger 547. Finally, a plug member 545 is attached to holder member 540 in the position shown.

INDUSTRIAL APPLICABILITY

The present invention finds potential applicability in any tappet driven fuel injector, especially those that face the possibility of becoming disconnected during shipping and handling prior to installation. The present invention finds particular applicability in tappet assemblies for mechanically actuated fuel injectors, but could also be used with other mechanical devices. The retention means of the present invention is especially applicable for use in those cases where space and structural constraints limit available space for external clamps and the like. When the invention is assembled it cannot come apart, and the means by which this is accomplished does not affect the operation of the fuel injector after installation. Because the retention means of the present invention preferably does not come into play after the fuel injector is installed in an engine, the displacement distance between the advanced position and the extended position need not be adjustable, which simplifies the structure versus some other devices.

The most preferred embodiment of the present invention, FIG. 4, includes several subtle but important advantages. First, the retention opening is circular, which is far easier to machine than the elongated slots that appear in many devices. Second, The retention member is concealed so that one potential opening for debris to enter the fuel injector is eliminated. Third, vertical design space is conserved since the plunger and tappet are partially guided on inner and outer surfaces of the injector body that overlap along a segment of the injectors length. Fourth, by using a cylindrical pin and retention surfaces that are perpendicular to the centerline, undesireable side forces on the tappet assembly are reduced or eliminated. Fifth, the use of a cylindrical pin also conserves a small but significant amount of vertical design space over rounded, especially spherical, retention members. Sixth, unlike some devices, the tappet assembly can rotate with respect to the injector body without interference from the retention means. This can further reduce the possibility of seizure after installation and simplifies the machining and assembly of the relevant injector components.

Those skilled in the art will appreciate that numerous modifications and alternative embodiments of the present invention will be apparent in view of the foregoing description. For instance, although the retention member in the FIGS. 2 and 3 embodiments has been illustrated as being a cylindrical pin, those skilled in the art will appreciate that retention members having other shapes, such as the oblong shape of FIG. 7, could work equally well. In addition, the indentation in which the retention member is trapped is preferably annular such that the tappet assembly can rotate with respect to the injector body both before and after installation; however, in some instances it may be desirable to make the indentation simply a vertical groove within which the cylindrical pin travels up and down during movement of the tappet assembly, but otherwise prevents the tappet assembly from rotating with respect to the injector body. This alternative is shown for example in FIG. 3.

Accordingly, this description is to be construed as illustrative only, and is for the purpose of teaching those skilled in the art the best mode of carrying out the invention. The details of the structure may be varied substantially without departing from the spirit of the invention, the scope of which is defined in terms of the claims as set forth below.

What is claimed is:

1. A fuel injector comprising:

an injector body;

a tappet assembly mounted on said injector body;

at least one of said tappet assembly and said injector body defining a retention opening therethrough;

a retention member positioned in said retention opening and concealed by at least one of said injector body and said tappet assembly;

said tappet assembly being moveable with respect to said injector body an unadjustable displacement distance between an advanced position and an extended position; and a height of said retention opening being less than said unadjustable displacement distance.

2. The fuel injector of claim 1 wherein said tappet assembly includes a tappet connected to a plunger;

said injector body includes an inner surface and an outer surface;

said tappet being slidably guided on said outer surface, and said plunger being slidably guided on said inner surface.

3. The fuel injector of claim 1 wherein said retention member is nonspherical in shape.

4. The fuel injector of claim 2 wherein said retention member consists essentially of a cylindrical pin.

5. The fuel injector of claim 1 wherein said tappet assembly has a centerline and includes a first retention surface;

said injector body includes a second retention surface; and said first retention surface and said second retention surface are substantially perpendicular to said centerline.

6. The fuel injector of claim 5 further comprising a spring operably positioned between said injector body and said tappet assembly to pinch said retention member between said first retention surface and said second retention surface when said tappet assembly is in said extended position.

7. The fuel injector of claim 1 wherein said tappet assembly has an installed retracted position that is between said advanced position and said extended position.

8. A fuel injector comprising:

an injector body defining a retention opening therethrough;

a tappet assembly with a centerline mounted on said injector body and including a tappet guided on an outer surface of said injector body, and a plunger guided on an inner surface of said injector body;

a portion of said outer surface and a portion of said inner surface are located along an identical segment of said centerline;

a retention member positioned in said retention opening and concealed by at least one of said injector body and said tappet assembly;

said tappet assembly being moveable with respect to said injector body an unadjustable displacement distance between an advanced position and an extended position; and a height of said retention opening being less than said unadjustable displacement distance.

9. The fuel injector of claim 8 wherein said tappet assembly includes a first retention surface substantially perpendicular to said centerline; and said injector body includes a second retention surface substantially perpendicular to said centerline.

10. The fuel injector of claim 9 further comprising a spring operably positioned between said injector body and said tappet assembly to pinch said retention member between said first retention surface and said second retention surface when said tappet assembly is in said extended position.

11. The fuel injector of claim 10 wherein said tappet assembly has an installed retracted position that is between said advanced position and said extended position.

12. The fuel injector of claim 11 wherein said retention member consists essentially of a cylindrical pin.

13. A fuel injector comprising:

an injector body;

a tappet assembly mounted on said injector body;

at least one of said tappet assembly and said injector body defining a circular retention opening therethrough;

a non-spherical retention member positioned in said retention opening and concealed by at least one of said injector body and said tappet assembly; and said tappet assembly being moveable with respect to said injector body a displacement distance between an advanced position and an extended position.

14. The fuel injector of claim 13 wherein said retention member has a circular cross section with a maximum diameter that is less than a diameter of said circular retention opening.

15. The fuel injector of claim 14 wherein said retention member has a substantially uniform cross section along its length.

16. The fuel injector of claim 15 wherein said tappet assembly includes a tappet connected to a plunger;

said injector body includes an inner surface and an outer surface;

said tappet being slidably guided on said outer surface, and said plunger being slidably guided on said inner surface.

17. The fuel injector of claim 16 wherein said tappet assembly has a centerline; and a portion of said outer surface and a portion of said inner surface are located along an identical segment of said centerline.

18. The fuel injector of claim 17 wherein said tappet assembly includes a first retention surface;

said injector body includes a second retention surface; and said first retention surface and said second retention surface are substantially perpendicular to said centerline.

19. The fuel injector of claim 17 further comprising a spring operably positioned between said injector body and said tappet assembly to pinch said retention member between said first retention surface and said second retention surface when said tappet assembly is in said extended position; and said tappet assembly has an installed retracted position that is between said advanced position and said extended position.

20. The fuel injector of claim 19 wherein said retention opening is through said injector body and located along said identical segment of said centerline.

* * * * *